United States Patent [19]

Thornton

[11] 4,431,942

[45] Feb. 14, 1984

[54] COLOR-CORRECTED HID MERCURY-VAPOR LAMP HAVING GOOD COLOR RENDERING AND A DESIRABLE EMISSION COLOR

[75] Inventor: William A. Thornton, Cranford, N.J.

[73] Assignee: North American Philips Electric Corp., New York, N.Y.

[21] Appl. No.: 318,230

[22] Filed: Nov. 4, 1981

[51] Int. Cl.[3] ..... H01J 1/62; H01J 63/04

[52] U.S. Cl. ..... 313/487; 313/635

[58] Field of Search ..... 313/487, 484, 486, 635; 252/301.4 P

[56] References Cited

U.S. PATENT DOCUMENTS

| | | | |
|---|---|---|---|
| 2,748,303 | 5/1956 | Thorington | 313/25 |
| 3,670,194 | 6/1972 | Thornton, Jr. et al. | 313/109 |
| 3,937,998 | 2/1976 | Verstegen et al. | 313/487 |
| 4,176,299 | 11/1979 | Thornton, Jr. | 315/326 |

*Primary Examiner*—David K. Moore
*Assistant Examiner*—Robert E. Wise

[57] ABSTRACT

Color-corrected HID mercury-vapor lamp provides good color rendition of illuminated objects and also has a commercially desirable emission color. The lamp incorporates the usual arc tube which emits both ultraviolet radiations and visible radiations and the color-correcting phosphor components are carried on the inner surface of an outer protective envelope and comprise three different phosphor components. A first of the phosphor components has an emission confined to the shorter wavelength region of the visible spectrum with a peak of emission at from 440 nm to 470 nm. A second of the phosphor components is confined to the middle wavelength region of the visible spectrum with a peak of emission at from 520 nm to 560 nm and the third of the phosphor components has an emission confined to the longer wavelength region of the spectrum with its peak of emission at from 605 nm to 630 nm. When the composite visible emissions from the arc tube and the phosphor components are combined, the emission color of the lamp at least approximates a cool-white color which is positioned at least proximate the black body line. Thus, the normal yellow-green emission of an uncorrected HPMV lamp is substantially color corrected in all respects.

6 Claims, 5 Drawing Figures

COLOR-CORRECTED HID MERCURY-VAPOR LAMP HAVING GOOD COLOR RENDERING AND A DESIRABLE EMISSION COLOR

BACKGROUND OF THE INVENTION

This invention relates to HID mercury-vapor lamps and, more particularly, to such a lamp which utilizes a particular phosphor combination in order that the visible output and appearance of the lamp are substantially color corrected in all respects.

High-pressure, mercury-vapor (HPMV) lamps are extensively used for lighting highways, parking lots, high-bay factories and similar applications. The visible emissions from such a lamp, when they are not otherwise corrected with respect to its color, are concentrated primarily in the green and yellow and violet regions of the visible spectrum. Such lamps have been color-corrected for many years by utilizing a coating of red-fluorescent phosphor material on the inner surface of the outer envelope, in order to utilize the otherwise wasted ultraviolet radiations which are generated by the arc. The first practical embodiment of such a lamp is described in U.S. Pat. No. 2,748,303, dated May 29, 1956. A modification of such a color-corrected lamp utilized yttrium vanadate activated by trivalent europium or yttrium phosphate vanadate activated by trivalent europium for purposes of color correction. With such a lamp, there still existed an excessive amount of yellow radiations from the mercury arc and in order to compensate for the excess of yellow radiations, U.S. Pat. No. 3,670,194 dated June 13, 1972 disclosed adding to the red-emitting phosphor component a limited amount of narrow blue-emitting phosphor. The resulting composite lamp emission provided good color rendering of illuminated objects. The emission color of the lamp, however, normally fell somewhat below the so-called black body line, which caused the lamp to have a purplish hue.

It is known that good color rendering of illuminated objects can be obtained with three selected narrow bands or lines of radiations, as taught in U.S. Pat. No. 4,176,299, dated Nov. 27, 1979.

The internationally accepted method for standardizing and measuring the color rendering properties of light sources is set forth in a publication of the International Commission on Illumination identified as Publication C.I.E. No. 13 (E-1.3.2) 1965.

SUMMARY OF THE INVENTION

There is provided a color-corrected high-pressure mercury-vapor lamp which has good color rendition of illuminated objects and which also has a commercially desirable appearance or emission color. The basic lamp comprises an arc tube which, when normally operated, emits both visible radiations and ultraviolet radiations and an outer protective envelope surrounds the arc tube. A phosphor coating is carried on the inner surface of the outer envelope and the phosphor coating substantially comprises three phosphor components. The first of the phosphor components when excited by the ultraviolet radiations has a fluorescent output which is substantially confined to the shorter wavelength region of the visible spectrum with a peak of emission at from 440 nm to 470 nm. A second of the phosphor components when excited by the ultraviolet radiations has a fluorescent output which is substantially confined to the middle wavelength region of the visible spectrum with its peak of emission at from 520 nm to 560 nm. The third of the phosphor components when excited by the ultraviolet radiations has a fluorescent output which is substantially confined to the longer wavelength region of the visible spectrum with its peak of emission at from 605 nm to 630 nm. The relative wattage outputs of the individual emissions of the first phosphor component and the second phosphor component, when measured with respect to the wattage output of the long wavelength emission of the third phosphor component, each is from 0.05:1 to 0.4:1. When the total emissions of the three phosphor components are combined with the visible emissions from the arc tube as normally operated, the appearance of the composite lamp emission at least approximates a cool-white color which is positioned at least proximate the black body line as inscribed on the x,y-chromaticity diagram of the ICI system.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
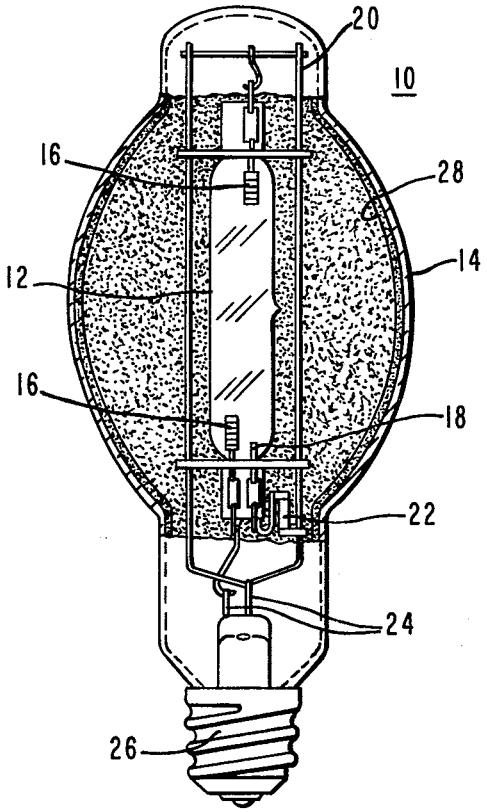
FIG. 1 is an elevational view, shown partly in section, of a high-pressure, mercury-vapor lamp which incorporates a phosphor coating in accordance with the present invention.

With specific reference to the form of the invention as shown in the drawings, the numeral 10 in FIG. 1 illustrates generally a high-pressure, mercury-vapor lamp comprising an inner arc tube 12 which is surrounded by a vitreous, light-transmitting outer envelope 14. The construction of the inner arc tube 12, which is normally fabricated of quartz, is well known and includes main electrodes 16 operatively disposed at either end thereof, and a starting electrode 18 positioned proximate one of the main electrodes 16. The arc tube 12 is suitably supported within the outer envelope 14 by a conventional supporting frame 20 and a starting resistor 22 is used to connect the starting electrode 18 to one side of the energizing potential. Energizing potential is supplied to the electrodes 16 of the power-operable arc tube through conventional lead-in conductors 24, which in turn electrically connect to a conventional screw-type base 26. The inner surface of the envelope 14 carries a coating 28 which principally comprises three phosphor components, as will be described in detail hereinafter.

Figure 2:
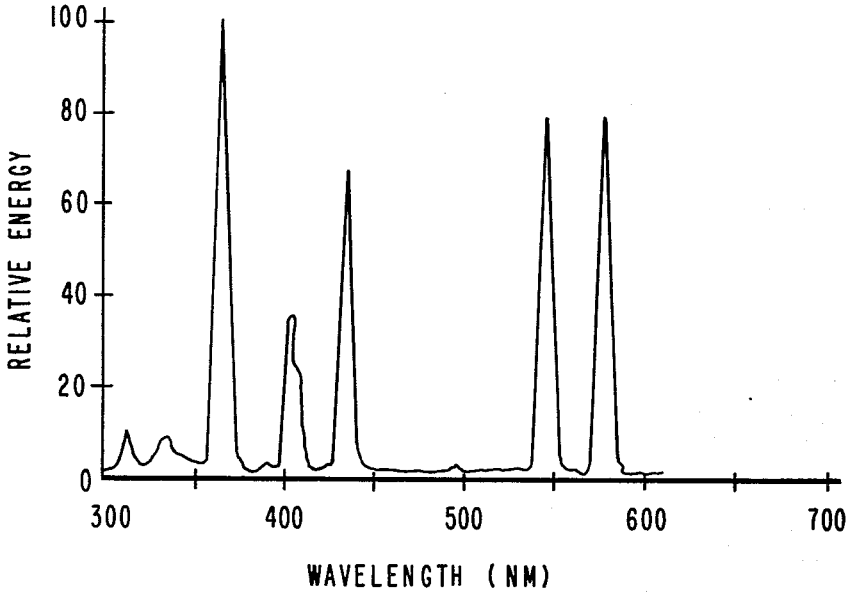
FIG. 2 PRIOR ART
FIG. 2 is a graph of relative energy vs. wavelength showing the spectral output of a standard high-pressure, mercury-vapor lamp at wavelengths from 300 nm to 700 nm.

In FIG. 2 is shown the spectral emission of a bare or otherwise uncorrected high-pressure, mercury-vapor arc for wavelengths of from 300 nm to 700 nm. There are also present other strong ultraviolet lines at wavelengths shorter than 300 nm, although these are not shown. In the practices of the prior art, it has been customary to color-correct the output of the mercury arc by adding long wavelength radiations such as by coating the inner surface of the outer envelope with phosphors of various types, including phosphors such as a yttrium vanadate or yttrium phosphate-vanadate activated by trivalent europium and modified by a small addition of blue-emitting phosphor, as described in the aforementioned Patent No. 3,670,194, dated June 13, 1972.

Figure 3:
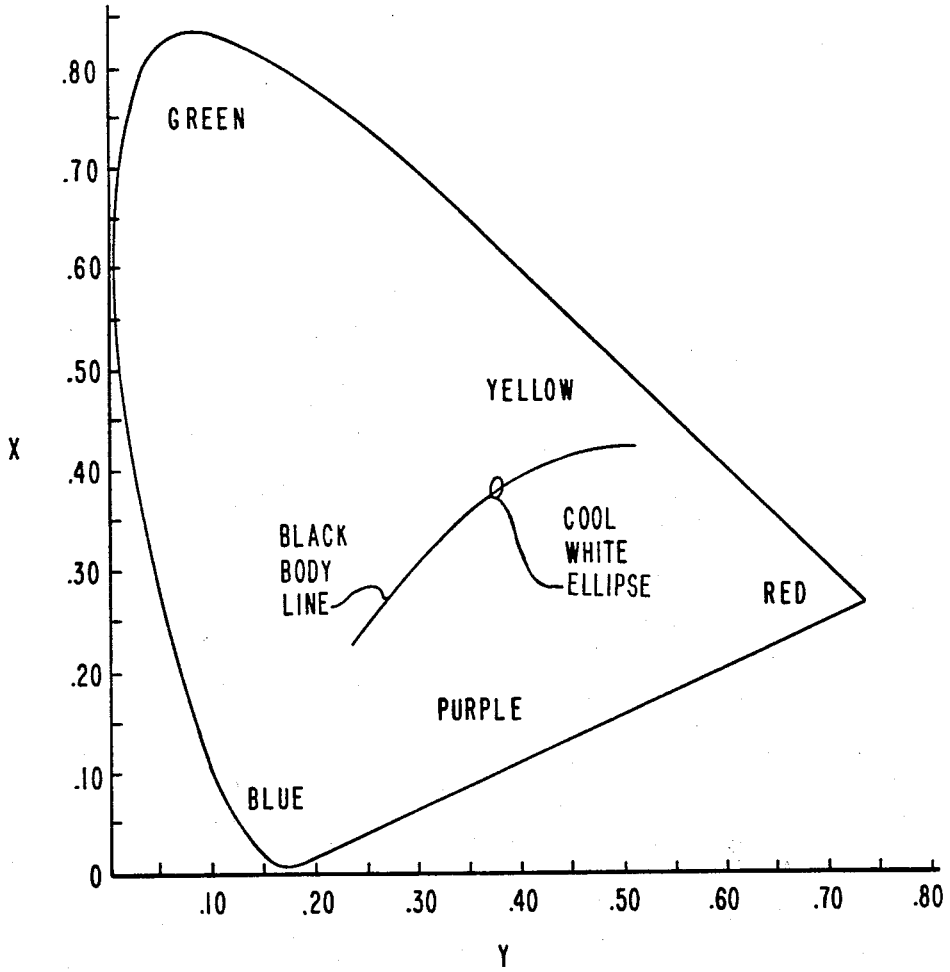
FIG. 3 sets forth the x,y-chromaticity diagram of the ICI system having inscribed thereon the black-body line along with the cool-white ellipse which is a desirable color appearance for a color-corrected HPMV lamp.

In FIG. 3 is shown the x,y-chromaticity diagram of the ICI system.

Figure 4:
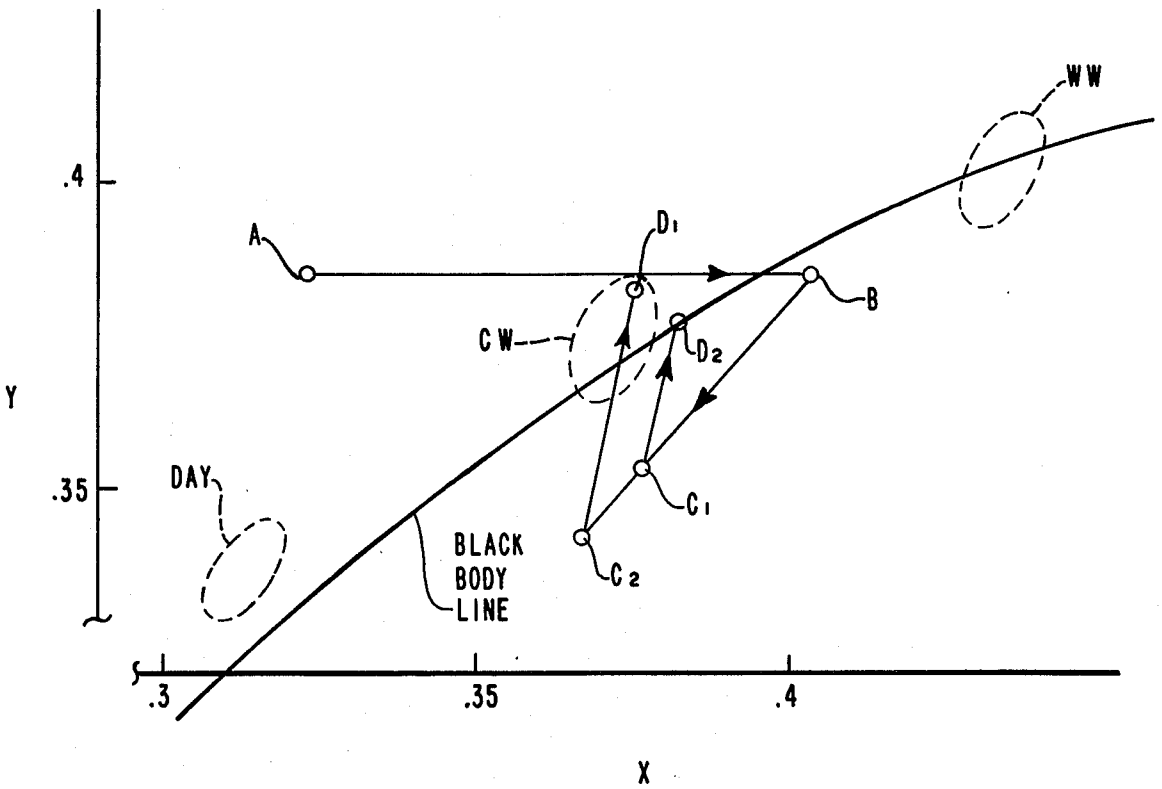
FIG. 4 is an enlarged view of a portion of the diagram as shown in FIG. 3 having inscribed thereon color coordinates for various lamps of the prior art and typical lamps constructed in accordance with the present invention.

A portion of this diagram is shown in FIG. 4 wherein the x,y coordinates for the composite emission of an uncorrected HPMV lamp are shown as the point designated "A". When such a lamp is color-corrected by incorporating a red-emitting phosphor such as the aforementioned yttrium-vandate or yttrium phosphate-vanadate, the added red emissions modify the output of the lamp so that it has color coordinates which can be expressed by the point designated "B" in FIG. 4. This point "B" falls approximately on the black-body line so that the emission color of the lamp is white in appearance. The composite emission of the lamp, however, still possesses a substantial amount of yellow radiations which are injurious to good color rendering of illuminated objects. To compensate for these yellow radiations, U.S. Pat. No. 3,670,194 discloses adding a limited amount of blue-emitting phosphor to the red-emitting phosphor and the resulting lamp has very good color rendition of illuminated objects. The blue radiations, however, cause the composite lamp emission to shift toward the purple. A typical composite lamp emission for a 400 watt lamp is represented by the point "$C_1$", and a typical composite lamp emission for a 1000 watt lamp is represented by the point "$C_2$" in FIG. 4. As a result, the lamp tends to have a purplish appearance or hue which is not considered desirable from a commercial standpoint.

In accordance with the present invention, there is added to the red-emitting and blue-emitting phosphor, a limited proportion of phosphor which has its emission substantially confined to the middle wavelength region of the visible spectrum with its peak of emission at from 520 nm to 560 nm. The emission of such material is greenish in color and this modifies the composite emission of the lamp so that it at least approximates a cool-white color and is positioned at least proximate the black-body line on the chromaticity diagram of the ICI system. The typical composite emission of such a lamp is shown as the points designated "$D_1$" and "$D_2$" in FIG. 4. The color temperature of the cool-white color is approximately 4000° K.

The color shift of the composite mercury discharge, as modified by the emission of the red-emitting phosphor, is represented in FIG. 4 by the line drawn between the points "A" and "B", with the arrow indicating the direction of the color shift. The amount of degree of color shift is dependent upon the relative amount of added red emission. The color shift from point "B" to points "$C_1$" or "$C_2$" is represented by the line drawn between these points, with the arrow indicating the direction of the color shift. The color shift from points "$C_1$" and "$C_2$" to points "$D_1$" and "$D_2$" is represented by the lines drawn between these points with the arrows indicating the direction of the color shifts. The final emission colors as represented by the points "$D_1$" and "$D_2$" can be varied by adjusting the relative phosphor emissions, with the composite emission falling in or near the cool white ellipse, shown in dashed lines and designated "CW". For purposes of comparison, the warm-white ellipse designated "WW" and the daylight ellipse designated "DAY" are also shown in FIG. 4.

Considering the present lamp more specifically, the phosphor coating 28 substantially comprises three phosphor components. A first of the phosphor components, when excited by the ultraviolet radiations, has a fluorescent output which is substantially confined to the shorter wavelength region of the visible spectrum and has its peak of emission at from 440 nm to 470 nm. The preferred phosphor for use in such a blend is strontium chloroapatite activated by divalent europium, although barium-magnesium aluminate activated by divalent, europium may be substituted therefor. Alternatively, mixtures of these blue-emitting phosphors can be utilized, if desired, and such phosphors are well known and are commercially available.

The second phosphor component, when excited by the ultraviolet radiations, has a fluorescent output which is substantially confined to the middle wavelength region of the visible spectrum and has its peak of emission at from 520 nm to 560 nm. As a specific example, the second phosphor component is one of zinc sulfide activated by copper, calcium sulfide activated by cerium, strontium aluminate activated by divalent europium, or calcium-magnesium aluminate activated by cerium and terbium. All of these phosphors are also well known and, if desired, any mixtures of these phosphors can be used as the second phosphor component.

The third phosphor component, when excited by the ultraviolet radiation, has a fluorescent output which is substantially confined to the longer wavelength region of the visible spectrum and has its peak of emission at from 605 nm to 630 nm. As a specific example, the third phosphor component is one of yttrium vanadate activated by trivalent europium or yttrium phosphate-vanadate activated by a trivalent europium. Such phosphors are well known and can be utilized either singly or mixed, if desired.

The three phosphor components are utilized in such proportions that the wattage output of the individual emissions of the first phosphor component and the second phosphor component, when measured with respect to the wattage output of the long wavelength emission of the third phosphor component, each is from 0.05:1 to 0.4:1, with the preferred ratio being about 0.2:1. If the phosphors are utilized as a homogeneous mixture, these relative wattage outputs can be expressed as a relative phosphor weight ratio. In other words, in the case of a homogeneous mixture, the relative weight of the first phosphor component and the relative weight of the second phosphor component, when expressed with respect to the weight of the third phosphor component, each has a weight ratio of from 0.05:1 to 0.4:1 with the preferred weight ratio being about 0.2:1. The total amount of phosphor which is utilized can vary considerably but a typical coating weight is from 1 to 8 $mg/cm^2$ of coated envelope surface.

Figure 5:
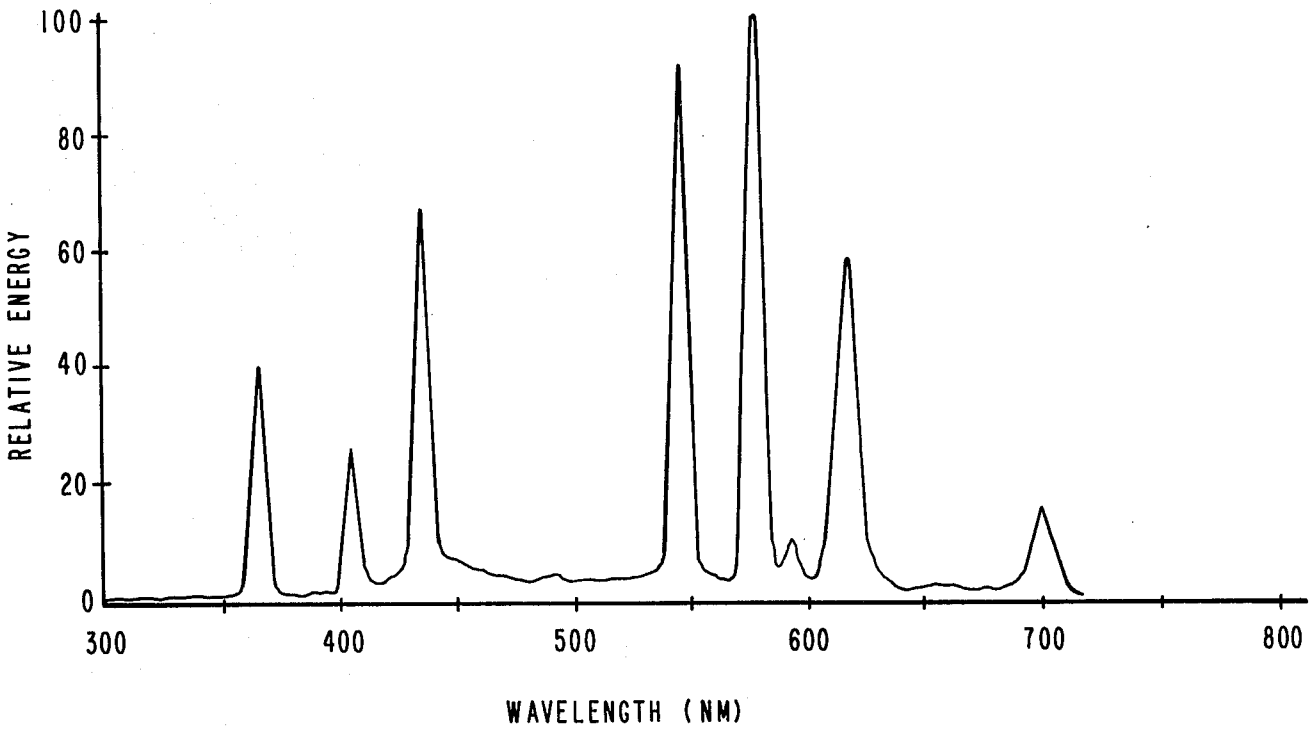
FIG. 5 is a graph of relative energy vs. wavelength showing the composite visible emission for a color-corrected mercury lamp constructed in accordance with the present invention.

When the total emissions of the first and second and third phosphor components are combined with the visible emissons from the arc tube, as normally operated, the composite lamp emission at least approximately a cool-white color and is positioned at least proximate the black-body line as inscribed on the x,y-chromaticity diagram of the ICI system. The color rendering index of the present lamp when measured by the C.I.E. method is somewhat improved over that of the lamp as described in U.S. Pat. No. 3,670,194. More importantly, the color appearance of the present lamp is very acceptable from a commercial standpoint. A typical spectral power distribution for the present lamp is shown in FIG. 5.

I claim:

1. A color-corrected high-pressure mercury-vapor lamp which provides good color rendition of illuminated objects and which also has a commercially desirable emission color, said lamp comprising an arc tube which, when normally operated, emits both visible and ultraviolet radiations, and an outer envelope surrounding said arc tube, a phosphor coating carried on the inner surface of said outer envelope, said phosphor coating substantially comprising three phosphor components, a first of said phosphor components when excited by said ultraviolet radiations having a fluorescent output which is substantially confined to the shorter wavelength region of the visible spectrum and has its peak of emission at from 440 nm to 470 nm, a second of said phosphor components when excited by said ultraviolet radiations having a fluorescent output which is substantially confined to the middle wavelength region of the visible spectrum and has its peak of emission at from 520 nm to 560 nm, and the third of said phosphor components when excited by said ultraviolet radiations has a fluorescent output which is substantially confined to the longer wavelength region of the visible spectrum and has its peak of emission at from 605 nm to 630 nm, the relative wattage outputs of said individual emissions of said first phosphor component and said second phosphor component when measured with respect to the wattage output of said long wavelength emission of said third phosphor component each is from 0.05:1 to 0.4:1, and the total of said emissions of said first and said second and said third phosphor components when combined with said visible emissions from said arc tube as normally operated producing a composite lamp emission which at least approximates a cool-white color and which is positioned at least proximate the black-body line as inscribed on the x,y-chromaticity diagram of the ICI system.

2. The lamp as specified in claim 1, wherein the relative wattage outputs of said individual emissions of said first phosphor component and said second phosphor component when measured with respect to the wattage output of said long wavelength emission of said third phosphor component each is about 0.2:1.

3. The lamp as specified in claim 1, wherein said first phosphor component is at least one of strontium chloroapatite activated by divalent europium and barium-magnesium aluminate activated by divalent europium, said second phosphor component is at least one of zinc sulfide activated by copper, calcium sulfide activated by cerium, strontium aluminate activated by divalent europium and calcium-magnesium aluminate activated by cerium and terbium, and said third phosphor component is at least one of yttrium vanadate activated by trivalent europium and yttrium phosphate vanadate activated by trivalent europium.

4. The lamp as specified in claim 1, wherein said first phosphor component is at least one of strontium chloroapatite activated by divalent europium and barium-magnesium aluminate activated by divalent europium, said second phosphor component is at least one of zinc sulfide activated by copper, calcium sulfide activated by cerium, strontium aluminate activated by divalent europium and calcium-magnesium aluminate activated by cerium and terbium, and said third phosphor component is at least one of yttrium vanadate activated by trivalent europium and yttrium phosphate vanadate activated by trivalent europium.

5. A color-corrected high-pressure mercury-vapor lamp which provides good color rendition of illuminated objects and which also has a commercially desirable emission color, said lamp comprising an arc tube which, when normally operated, emits both visible and ultraviolet radiations, and an outer envelope surrounding said arc tube, a phosphor coating carried on the inner surface of said outer envelope, said phosphor coating substantially comprising a mixture of three finely divided phosphor components, a first of said phosphor components when excited by said ultraviolet radiations having a fluorescent output which is substantially confined to the shorter wavelength region of the visible spectrum and has its peak of emission at from 440 nm to 470 nm, a second of said phosphor components when excited by said ultraviolet radiations having a fluorescent output which is substantially confined to the middle wavelength region of the visible spectrum and has its peak of emission at from 520 nm to 560 nm, and the third of said phosphor components when excited by said ultraviolet radiations has a fluorescent output which is substantially confined to the longer wavelength region of the visible spectrum and has its peak of emission at from 605 nm to 630 nm, the relative weight of said first phosphor component and the relative weight of said second phosphor component when expressed with respect to the weight of said third phosphor component each has a ratio of from 0.05:1 to 0.4:1, and the total of said emissions of said first and said second and said third phosphor components when combined with said visible emissions from said arc tube as normally operated producing a composite lamp emission which at least approximates a cool-white color and which is positioned at least proximate the black-body line as inscribed on the x,y-chromaticity diagram of the ICI system.

6. The lamp as specified in claim 5, wherein the relative weight of said first phosphor component and the relative weight of said second phosphor component when expressed with respect to the weight of said third phosphor component each has a ratio of about 0.2:1.

* * * * *